US007458500B2

(12) United States Patent
Whitaker et al.

(10) Patent No.: US 7,458,500 B2
(45) Date of Patent: Dec. 2, 2008

(54) COMMERCIAL BULK ICE CREAM OR FROZEN NOVELTY CONTAINER AND METHOD OF MANUFACTURE

(75) Inventors: John Clifford Whitaker, Cincinnati, OH (US); Klaus Michael Koessendrup, Schifferstadt (DE)

(73) Assignee: ABRO Weidenhammer GmbH, Hockenheim (DE)

( * ) Notice: Subject to any disclaimer, the term of this patent is extended or adjusted under 35 U.S.C. 154(b) by 722 days.

(21) Appl. No.: 10/899,877

(22) Filed: Jul. 27, 2004

(65) Prior Publication Data

US 2006/0022021 A1 Feb. 2, 2006

(51) Int. Cl.
*B65D 3/28* (2006.01)
*B65D 3/10* (2006.01)

(52) U.S. Cl. ..... 229/5.5; 229/4.5

(58) Field of Classification Search ..... 229/4.5, 229/5.5, 5.6, 5.7, 5.8, 125.13
See application file for complete search history.

(56) References Cited

U.S. PATENT DOCUMENTS

| | | | | | |
|---|---|---|---|---|---|
| 2,335,202 | A | * | 11/1943 | Wilcox | 229/4.5 |
| 3,186,620 | A | * | 6/1965 | Meijers | 229/5.7 |
| 3,315,865 | A | * | 4/1967 | Bracht | 229/5.6 |
| 3,377,014 | A | * | 4/1968 | Rocher | 229/5.5 |
| 3,408,902 | A | * | 11/1968 | De Voe | 493/56 |
| 3,434,651 | A | * | 3/1969 | Stec | 229/123.1 |
| 3,561,637 | A | | 2/1971 | McConnell | |
| 4,091,929 | A | | 5/1978 | Krane | 206/602 |
| 4,094,460 | A | * | 6/1978 | Scanga et al. | 229/123.1 |
| 4,289,265 | A | * | 9/1981 | Ellerbrock | 229/5.5 |
| 4,346,815 | A | | 8/1982 | Raymor et al. | 220/306 |
| 4,346,832 | A | * | 8/1982 | Werner | 229/4.5 |
| 4,369,892 | A | * | 1/1983 | Uhlig | 220/320 |
| 4,531,930 | A | * | 7/1985 | Clauss | 493/108 |
| 4,546,911 | A | | 10/1985 | Clauss | |
| 4,738,365 | A | | 4/1988 | Prater | 206/625 |
| 4,785,992 | A | * | 11/1988 | Goeppner | 229/5.6 |
| 4,852,793 | A | * | 8/1989 | Homma et al. | 229/5.5 |
| 5,258,086 | A | * | 11/1993 | Hale | 156/190 |
| 6,116,422 | A | | 9/2000 | Rabe et al. | |
| 6,138,899 | A | * | 10/2000 | Grabher | 229/5.5 |
| 6,165,115 | A | * | 12/2000 | Rea | 493/109 |
| 6,401,967 | B1 | | 6/2002 | Rabe et al. | 220/796 |
| 2003/0116579 | A1 | | 6/2003 | Chambers | |
| 2006/0073959 | A1 | | 4/2006 | Michael | |

OTHER PUBLICATIONS

U.S. Appl. No. 11/287,416 Non-Final Office Action mailed Jun. 15, 2007, 6 pgs.

* cited by examiner

*Primary Examiner*—Gary E Elkins
(74) *Attorney, Agent, or Firm*—Schwegman, Lundberg & Woessner, P.A.

(57) ABSTRACT

A cardboard sidewall has a volume of greater than or equal to one and half gallons. A cardboard bottom includes a polyethylene coating on an inside of the bottom. An inside of the sidewall also includes a polyethylene coating. The bottom is heat sealed onto a bottom portion of the sidewall to form a seal. Furthermore, in one embodiment, a plastic ring is affixed to an inside of a top portion of the sidewall.

6 Claims, 3 Drawing Sheets

COMMERCIAL BULK ICE CREAM OR FROZEN NOVELTY CONTAINER AND METHOD OF MANUFACTURE

FIELD OF THE INVENTION

The present invention is related to containers, and more specifically to commercial bulk ice cream or frozen novelty containers.

BACKGROUND OF THE INVENTION

Packaging of Bulk ice cream and frozen novelties (e.g., sherbet, etc.) has largely consisted of creating cylindrical tubs (containers) for which ice cream is filled. The containers are used to transport and dispense ice cream or frozen novelties to consumers. Retail or consumer-based containers differ from one another in terms of their respective volumes. That is, a retail ice cream or frozen novelty container typically holds one pint to ½ gallon of ice cream or frozen novelty. Conversely, a commercial bulk ice cream or frozen novelty container holds one and half gallons of product or more.

Because commercial bulk ice cream or frozen novelty containers have to support a much larger volume of product than do retail or consumer-based containers, the commercial containers are at least partially constructed with metal or derivatives thereof. Moreover, materials are often used with the construction of ice cream or frozen novelty containers to prevent the containers from rupturing due to exposures to extreme temperatures and liquid (melted product).

One problem with commercial bulk ice cream or frozen novelty container construction is that a metal ring is used around the top and bottom sides of the container for purposes of structural support of the container, which is largely cardboard. This metal ring can become a hazard for an employee of a business that ultimately dispenses the product from the container to a consumer, because that employee's hand can come in contact with the underside of the metal ring or frayed portions of a damaged metal ring, such that the employee's hand is cut. This may result in blood being spilled into the product; thereby creating contaminated product. Should a consumer become ill or notice the blood, then this creates adverse public relations for a business owner and may affect ice cream sales.

Additionally, an employee may temporarily leave work for his/her employer with an injury and/or claim worker's compensation benefits when his/her hand or wrist is injured while dispensing ice cream. This results in financial loss to the business owner. Moreover, any contaminated product will have to be disposed of by the business owner, resulting in increased cost associated with the business owner's product inventory.

Another aspect of commercial bulk ice cream or frozen novelty container construction is that because a plurality of disparate materials are used, such as cardboard and metal, the production costs and assembly techniques can be more complicated and may be more expensive than is actually needed (as will be demonstrated herein and below with descriptions and embodiments of this invention). This adds to the expenses of business owners and increases consumer prices paid for product that is vended from the business owners.

Another problem that exists with conventional commercial bulk ice cream or frozen novelty construction is the use metal around the top and bottom of the container. This is done for structural support of the container, but it also prevents the product from being scanned by a metal detector for purposes of determining if the product has been tampered with or contains contaminants. With today's increasing concern for food safety, the existing metal rings make it difficult to properly screen product or commercial bulk ice cream or frozen novelty containers.

Therefore, there is a need for an improved commercial ice cream container.

SUMMARY OF THE INVENTION

Briefly and in general terms, a commercial bulk ice cream or frozen novelty container is provided. The container includes a cardboard sidewall formed into a cylinder that includes a volume of greater than or equal to 1 and ½ gallons. The container also includes a cardboard bottom that overlaps and is seals to a bottom portion of the sidewall. In one embodiment, the container also includes a plastic ring affixed to a top of the sidewall.

More specifically, and in one embodiment, an inside of the bottom is coated with polyethylene and the inside of sidewall also includes a polyethylene coating. In one embodiment, the inside of the bottom and the inside of the sidewall are heated to melt the polyethylene coatings. In one embodiment, the inside of the bottom is then folded over the bottom portion of the sidewall on the outside of the bottom portion of the sidewall and then cooled; thereby sealing the bottom to the sidewall.

Still other aspects of the present invention will become apparent to those of ordinary skill in the art from the following description of various embodiments of the invention. As will be realized the invention is capable of other embodiments, all without departing from the present invention. Accordingly, the drawings and descriptions are illustrative in nature and not intended to be restrictive.

DETAILED DESCRIPTION OF THE INVENTION

In the following description and the drawings illustrate specific embodiments of the invention sufficiently to enable those of ordinary skill in the art to practice it. Other embodiments may incorporate structural, logical, electrical, material, process, and other changes. Examples merely typify possible variations. Individual components and functions are optional unless explicitly required, and the sequence of operations may vary. Portions and features of some embodiments may be included in or substituted for those of others. The scope of the invention encompasses the full ambit of the claims and all available equivalents. The following description is, therefore, not to be taken in a limited sense, and the scope of the present invention is defined by the appended claims.

Figure 1:
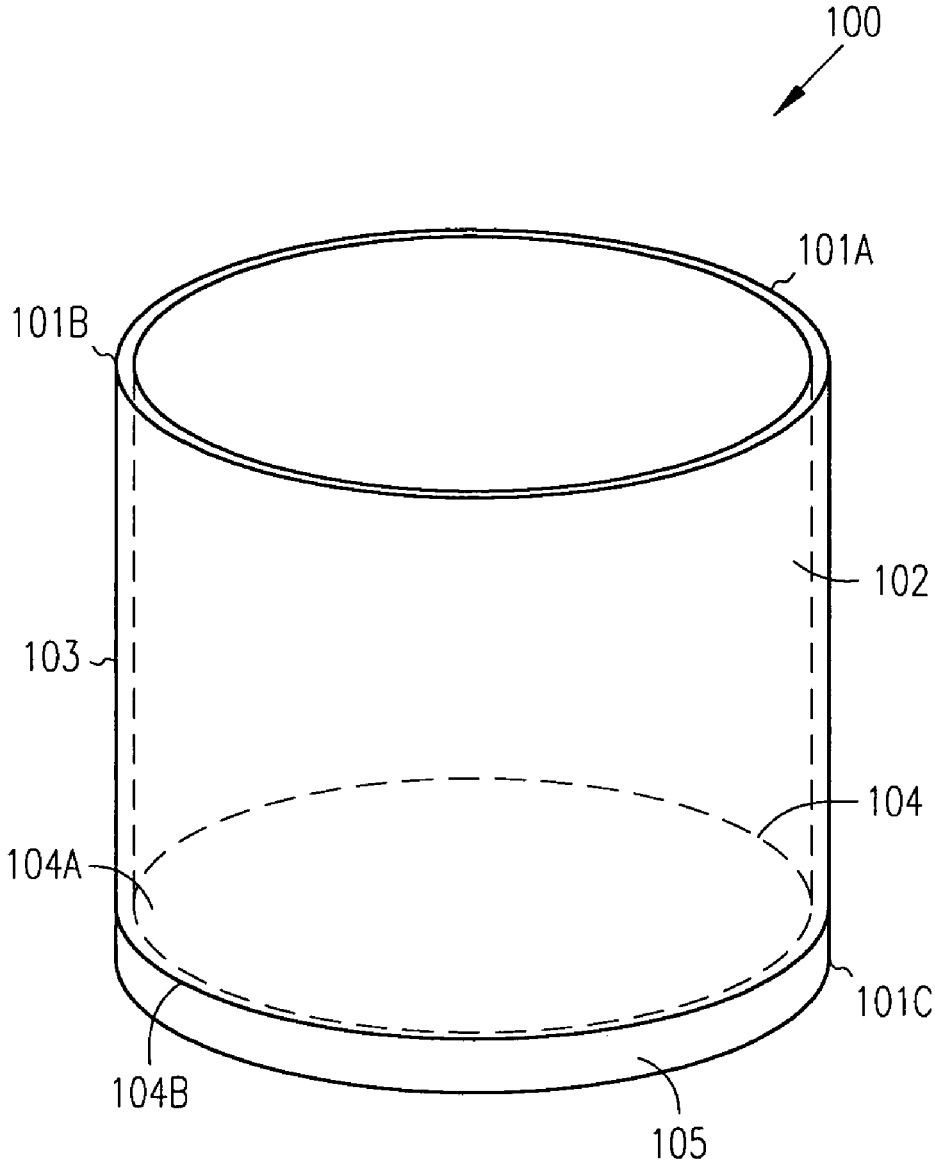
FIG. 1 is a diagram of a commercial bulk ice cream or frozen novelty container, according to an example embodiment of the invention.

FIG. 1 is a diagram of a commercial bulk ice cream or frozen novelty container 100, according to an example embodiment of the invention. The container 100 is specifically adapted for improved housing, transporting, inspecting, and/or dispensing of bulk ice cream or frozen novelties.

Moreover, the container 100 is commercial in that it is capable of housing greater than or equal to 1 and ½ gallons of product.

The container 100 includes a sidewall 101A and a bottom 104. Moreover, the sidewall 101A is oriented to have a top portion 101B and a bottom portion 101C. The sidewall 101A also includes an inside 102 and an outside 103. The sidewall 101A is constructed of cardboard. In one embodiment, the cardboard is non-recycled Virgin Kraft and includes a polythene coating on at least the inside 102 of the sidewall 101A. Further, the sidewall 101A forms a void having a volume of greater than or equal to 1 and ½ gallons. This void receives liquid product (e.g., ice cream or frozen novelty), which is then frozen within the container 100 for transporting, inspecting, storing, and dispensing the product.

The bottom 104 includes an inside 104A and an outside 104B. The inside 104A of the bottom 104 is oriented towards the inside 102 of the sidewall 101A. The bottom 104 is also constructed of cardboard and in one embodiment includes a polyethylene coating on the inside 104A but not on the outside 104B. Again, in one embodiment, the outside 104B of the bottom is constructed of Virgin Kraft. The bottom 104 is sealed to the sidewall 101A along the bottom portion 101C of the sidewall 101A.

In one embodiment, the bottom 104 has a circumference that is greater than the circumference of the bottom portion 101C of the sidewall 101A. This excess circumference is folded over the outside 103 of the bottom portion 101C of the sidewall 101A. In another embodiment, portions of the bottom 104 (e.g., excess circumference) are folded over both the inside portion 102 of the sidewall 101A and the outside portion 103 of the sidewall 101A. In this latter embodiment, a recess 105 may be created between the bottom portion 101C of the sidewall 101A and portions of the bottom 104 not in contact with the sidewall 101A. In yet another embodiment, portions of the bottom 104 (e.g., excess circumference) are folded on the inside 102 of the bottom portion 101C of the sidewall 101A and a curl process may optionally be used to seal the bottom 104 to the bottom portion 101C of the sidewall 101A.

In one embodiment, the bottom 104 is sealed by heating the polyethylene coating on the inside 104A of the bottom 104. Concurrently, the polyethylene coating on the inside 102 of the sidewall 101A (and perhaps a polyethylene coating on the outside 103 of the sidewall 101A) is heated in order to seal at least a portion of the polyethylene coating(s) of the sidewall 101A.

In some embodiments, the bottom 104 is then folded (using a variety of techniques described above) over the bottom portion 101C of the sidewall 101A and allowed to cool, where the melted polyethylene coatings seal with one another forming a seal between the bottom 104 and the bottom portion 101C of the sidewall 101A. The excess cardboard circumference of the inside 104A of the bottom 104 remain in contact with the outside 103, inside 102, or inside 102 and outside 103 of the sidewall 101A. Conversely, the outside 104B of the bottom 104 does not come in contact with the sidewall 101A.

It should also be noted, in some embodiments, that the outside 104B of the bottom 104 does not include a polyethylene coating. In this manner, when the bottom 104 is heat sealed to the outside 103 of the sidewall 101A via its inside 104A, the outside 104B of the bottom 104 retains paper properties and is more resistant to heat and is conducive to sealing the inside 104A of the bottom 104 to the bottom portion 101C of the sidewall 101A which also includes polyethylene coatings. This reduces production difficulties in sealing the bottom 104 to the bottom portion 101C of the sidewall 101A.

Moreover, it should be noted that the bottom 104 is a single constructed piece of cardboard; however for purposes of describing various embodiments of the invention, the single bottom 104 was described as having an inside 104A and an outside 104B. Similarly, the sidewall 101A is a single piece of cardboard; however for purposes of describing various embodiments, the arrangements, and orientations, the sidewall 101A was labeled in FIG. 1 as having a top portion 101B, a bottom portion 101C, an inside 102 and an outside 103.

Figure 2:
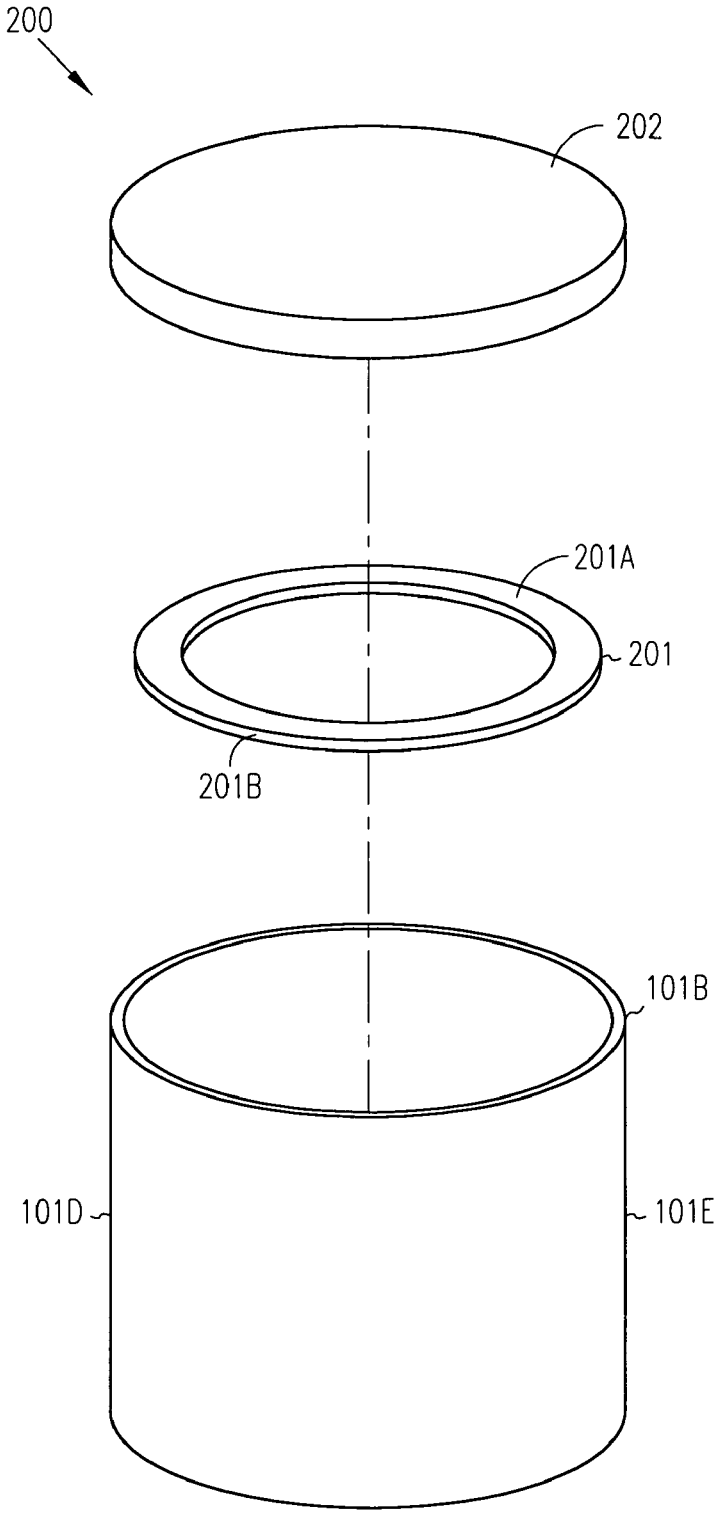
FIG. 2 is a diagram of a different view of a top of a sidewall of the container of FIG. 1 and having additional components, according to an example embodiment of the invention.

FIG. 2 is a diagram of another view of the top portion 101B of the sidewall 101A of the container of FIG. 1, according to an example embodiment of the invention. Moreover, FIG. 2 includes other optional components of the container 100 of FIG. 1.

In some embodiments, a plastic support ring 201 is affixed to the container 100. The plastic ring 201 includes ribs 201A which are manufactured by injection molding into one side of the plastic ring 201. The side having the ribs 201 are forced or pressed into the inside 102 of the top portion 101B of the sidewall 101A of the container 100. In one embodiment, the plastic ring 201 has a circumference that is slightly larger than the circumference of the top portion 101B of the sidewall 101A. The plastic ring 201 remains in place via friction between the ribs 201A and against the top portion 101B and the force exerted by the plastic ring 201 against the sidewall 101A which forces the walls 101D and 101E of the sidewall 101A outward. An opposite and equal force is exerted by the walls 101D and 101E against the plastic ring 201 in attempting to return it to its original condition. The result is the plastic ring 201 remains affixed to the top portion 101B of the sidewall 101A.

In one embodiment, the plastic ring 201 fits within the inside 102 of the sidewall 101A and does not extend to the outside 103 of the sidewall. Another side 201B of the plastic ring 201 is smooth and is not in contact with the sidewall 101A.

In another embodiment, a lid or top piece 202 may also be provided. Again, the lid or top piece 202 is cardboard (although in some embodiments it may be plastic). The lid or top piece 202 can be used to cover the top portion 101B of the sidewall 101A and is removable, as indicated by the dual-sided arrow heads in FIG. 2. The lid or top piece 202 comes into contact with the outside 103 of the sidewall 101A when it is closed over or pressed onto the top portion 101B of the sidewall 101A.

In a different embodiment, the lid is a re-sealable plastic wrap, which can be pealed off the top portion 101B of the sidewall 101A and re-sealed by re-covering the top portion 101B of the sidewall 101A.

The plastic ring 201 provides additional upper structural support to the container 100. Moreover, the plastic ring 201 permits the container 100 to be scanned by a metal detector. As a result, the containers 100 of the present invention can be scanned by metal detectors for metal contaminants something which has not been conventionally achievable with conventional containers that have included metal support rings along the bottom and top portions of the conventional containers. This provides greater food safety and reduces liability considerations for ice cream and frozen novelty manufacturers.

One of ordinary skill in the art now appreciates how a commercial bulk ice cream or frozen novelty container 100 may be constructed entirely of cardboard, and optionally a plastic ring. In some embodiments, this is achieved with just two pieces of cardboard, namely a sidewall 101A and a bottom 104. In another embodiment, a plastic ring 201 is added to a top portion 101B of the sidewall 101A. In yet another embodiment, a cardboard lid 202 is added.

Thus, a commercial bulk ice cream or frozen novelty container may now be constructed with 2-4 components and the resulting container 100 has the structural integrity to house one and half gallons of product or more. This improves frozen product dispensing safety by eliminating conventional metal rings and metal components, which are not detected on metal scans and which may injure individuals dispensing the frozen product. Additionally, it streamlines the production procedure, reduces the amount of components needed when manufacturing the containers 100, and reduces expenses associated with manufacturing the containers 100.

Figure 3:
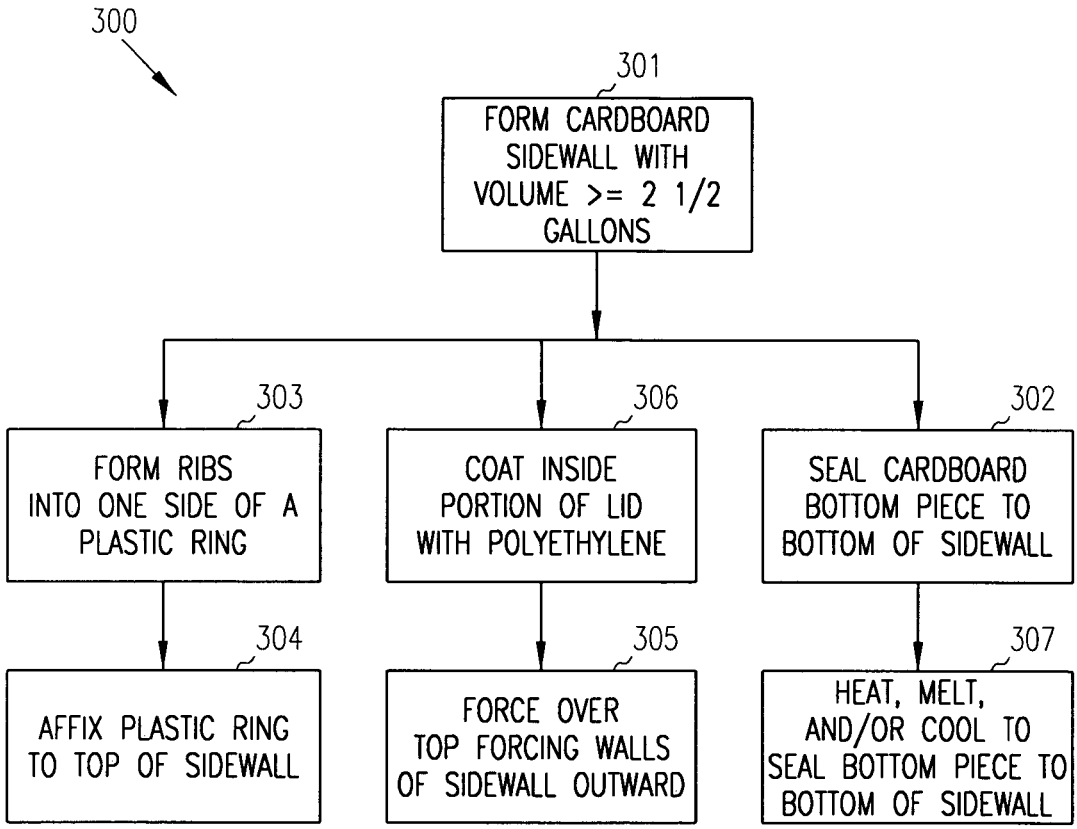
FIG. 3 is a diagram of a method for creating a commercial bulk ice cream or frozen novelty container of FIG. 1, according to an example embodiment of the invention.

FIG. 3 is a diagram of a method 300 for creating a commercial bulk ice cream or frozen product container of FIG. 1, according to an embodiment of the invention. The method 300 may be implemented by modifying conventional machines and materials used to manufacture commercial bulk ice cream or frozen novelty containers.

Initially, the appropriate or desired volume of a commercial ice cream or frozen novelty container is defined. This volume is configurable and is at least 1 and ½ gallons. The volume determination will drive the size of components used in the method 300. In one embodiment, the method 300 manufactures a novel commercial bulk ice cream or frozen novelty container, such as the one described above with FIGS. 1 and 2, and uses at least two cardboard components, namely a cylindrical sidewall 101A and a bottom 104. In other embodiments, described above with FIG. 2, the method 300 also includes one to two additional components, a plastic ring 201 and/or a cardboard lid 202.

Accordingly, at 301, a cardboard sidewall having a volume of at least 1 and ½ gallons is formed into a cylinder. At 302, a cardboard bottom is sealed to the sidewall.

In one embodiment, this is achieved by acquiring the bottom in a size that has a circumference that slightly exceeds the circumference of the bottom portion of the sidewall. The excess cardboard of the bottom's circumference is then folded over the outside of a bottom portion of the sidewall. In other embodiments, the bottom's excess circumference is folded onto only the inside of the bottom portion of the sidewall and a curl process is used to affix or seal the bottom to the sidewall. In yet other embodiments, the bottom's excess circumference is folded over and onto both the inside and outside of the bottom portion of the sidewall.

The seal may be achieved, at 307, by heating a polyethylene coating included on an inside of the bottom and heating polyethylene coating(s) included on the inside and/or outside of the bottom portions of the sidewall. The melted polyethylene coatings adhere with one another when allowed to cool to room or ambient temperature and form a seal between the bottom and the bottom portion of the sidewall.

In one embodiment, at 303, a plastic ring is formed with protruding ribs which are molded into one side of the plastic ring. These ribs permit a plastic ring, such as the one described above with FIG. 2, to be affixed or adhered to the top portion of the sidewall, as depicted at 304. This can be achieved, at 305, by forcing the plastic ring down over the top portion of the sidewall, which forces walls of the sidewall outward providing added upper support to the container. The ribs also keep the plastic ring affixed to and in constant friction with the sidewall.

In still other embodiments, a cardboard lid is provided where, at 306, and inside of the cardboard lid is coated with polyethylene. The lid is adapted to be placed over the top portion of the sidewall to cover the top opening of the sidewall. The lid is removable for purposes filling the container with product and for purposes of dispensing product from the container.

Embodiments of commercial bulk ice cream or frozen novelty containers and methods of manufacturing the same have been described. These embodiments improve the safety of dispensing ice cream over commercial containers and reduce and simplify the expense associated with manufacturing containers.

Although specific embodiments have been illustrated and described herein, those of ordinary skill in the art will appreciate that any arrangement calculated to achieve the same purpose can be substituted for the specific embodiments shown. This disclosure is intended to cover any and all adaptations or variations of various embodiments of the invention. It is to be understood that the above description has been made in an illustrative fashion, and not a restrictive one. Combinations of the above embodiments, and other embodiments not specifically described herein will be apparent to one of ordinary skill in the art upon reviewing the above description. The scope of various embodiments of the invention includes any other applications in which the above structures and methods are used. Therefore, the scope of various embodiments of the invention should be determined with reference to the appended claims, along with the full range of equivalents to which such claims are entitled.

It is emphasized that the Abstract is provided to comply with 37 C.F.R. §1.72(b) requiring an Abstract that will allow the reader to quickly ascertain the nature and gist of the technical disclosure. It is submitted with the understanding that it will not be used to interpret or limit the scope or meaning of the claims.

In the foregoing Detailed Description, various features are grouped together in a single embodiment for the purpose of streamlining the disclosure. This method of disclosure is not to be interpreted as reflecting an intention that the claimed embodiments of the invention require more features than are expressly recited in each claim. Rather, as the following claims reflect, inventive subject matter lies in less than all features of a single disclosed embodiment. Thus the following claims are hereby incorporated into the Detailed Description, with each claim standing on its own as a separate preferred embodiment.

The invention claimed is:

1. A commercial bulk ice cream or frozen novelty container, comprising:

a cardboard cylindrical sidewall having a volume of greater than or equal to one and a half gallons, and wherein the sidewall has a top portion and a bottom portion;

a cardboard bottom sealed to the bottom portion of the sidewall, wherein a portion of an inside of the bottom overlaps the bottom portion of the sidewall on an outside of the sidewall;

a plastic ring affixed to the top portion of the sidewall, wherein the plastic ring includes ribs on one side of the plastic ring that contacts an inside of the top portion of the sidewall, and wherein the plastic ring has a larger circumference than the top portion of the sidewall; and a cardboard lid that fits over and is removable from the top portion of the sidewall.

2. The commercial bulk ice cream or frozen novelty container of claim 1, wherein an inside of the sidewall includes a polyethylene coating.

3. A commercial bulk ice cream or frozen novelty container, comprising:

a cardboard sidewall forming a volume greater than or equal to one and half gallons, the sidewall having an inside adapted to house frozen product and an outside, and wherein the sidewall includes a top portion and a bottom portion;

a cardboard bottom sealed to the sidewall, wherein an inside of the cardboard bottom is coated with polyethylene;

a plastic ring affixed to the top portion of the sidewall, wherein one side of the plastic ring includes ribs, the ribs in contact with a top portion of the sidewall, and wherein the plastic ring has a larger circumference than the sidewall; and a cardboard lid that fits over and is removable from the top portion of the sidewall.

4. The commercial bulk ice cream or frozen novelty container of claim 3 wherein an inside portion of the lid includes a polyethylene coating.

5. The commercial bulk ice cream or frozen novelty container of claim 3, wherein the inside of the sidewall includes a polyethylene coating.

6. The commercial bulk ice cream or frozen novelty container of claim 3, wherein the sidewall is a virgin kraft cardboard.

* * * * *